United States Patent [19]

McCrea

[11] 4,215,327

[45] Jul. 29, 1980

[54] SUPPORT ASSEMBLY FOR CRYOGENICALLY COOLABLE LOW-NOISE CHOKED WAVEGUIDE

[76] Inventor: Robert A. Frosch, Administrator of the National Aeronautics and Space Administration, with respect to an invention of Frank E. McCrea, Arcadia, Calif.

[21] Appl. No.: 938,293

[22] Filed: Aug. 31, 1978

[51] Int. Cl.[2] ..... H01P 1/08; H01P 5/00; H01P 1/04; H01P 1/16

[52] U.S. Cl. ..... 333/252; 333/12; 333/99 S

[58] Field of Search ..... 333/99 S, 12, 248, 208, 333/252, 260, 251; 313/17, 18; 331/94.5 P, 94.5 D, 94, 96, 68–69; 29/599, 600; 307/424, 425, 426, 427, 428, 429; 361/381, 382, 385

[56] References Cited

U.S. PATENT DOCUMENTS

| | | | |
|---|---|---|---|
| 2,421,912 | 6/1947 | Spooner | 333/252 X |
| 3,094,628 | 6/1963 | Jiu | 333/99 S |
| 3,211,947 | 10/1965 | Bloom | 315/32 |
| 3,343,035 | 9/1967 | Garwin | 333/99 S X |
| 3,440,881 | 4/1969 | Weissman | 333/99 S |
| 3,441,880 | 4/1969 | Weissman et al. | 333/99 S X |
| 3,796,977 | 3/1974 | Elliot et al. | 333/248 X |
| 3,902,143 | 8/1975 | Fletcher et al. | 333/248 X |
| 3,906,412 | 9/1975 | Meyerhoff | 333/99 S X |

FOREIGN PATENT DOCUMENTS

| | | | |
|---|---|---|---|
| 584895 | 10/1959 | Canada | 333/252 |
| 859887 | 1/1961 | United Kingdom | 333/252 |

*Primary Examiner*—Marvin L. Nussbaum
*Attorney, Agent, or Firm*—Monte F. Mott; John R. Manning; Wilfred Grifka

[57] ABSTRACT

A compact cryogenically coolable choked waveguide particularly for low-noise input coupling into a cryogenically cooled device, such as a maser or parametric amplifier, utilizes coaxial stainless steel support tubes surrounding the waveguide and connected in cascade to provide a folded low thermal conduction path. The edges of the tubes connected are welded.

15 Claims, 2 Drawing Figures

SUPPORT ASSEMBLY FOR CRYOGENICALLY COOLABLE LOW-NOISE CHOKED WAVEGUIDE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to a low-noise choked waveguide, and more particularly to an assembly that has low noise characteristics and low heat transfer for supporting a waveguide through cryogenically cooled space.

In microwave systems, it is often necessary to couple a waveguide that is at ambient temperature (300° K.) to some cryogenically cooled device, such as a parametric amplifier at 70° K., or a maser at 4° K. This requires a cooled waveguide, but since the waveguide itself is a good thermal conductor, leakage and interference is experienced, thus degrading the sensitivity of such low-noise microwave amplifiers. In the past, a choked waveguide has been thermally spaced from a mounting plate at ambient temperature by spacers made of a material that exhibits very low thermal conductivity. That arrangement has been found to contribute 3° to 3.5° K. noise. It would be desirable to reduce this noise contribution by an order of magnitude to about 0.32° K.

SUMMARY OF THE INVENTION

In accordance with the present invention, a cryogenically coolable waveguide having a quarter-wavelength choke plate is thermally spaced apart from a mounting plate at a higher temperature by at least one pair of coaxial support tubes which surround the cooled waveguide. One end of the inner tube is connnected to the choke plate of the waveguide, and the free end of the inner tube (which surrounds the waveguide) is connected to a corresponding free end of the outer coaxial tube. The other end of the outer tube is connected to a mounting flange that is adapted to be connected to the mounting plate with the face of the mounting plate spaced in front of the choke plate the necessary choke gap. When space limitations require, a second pair of coaxial tubes may be used. The free end of the inner tube in the first pair is connected to the one end of the inner tube of the second pair, and the free end of the inner tube of the second pair (which surrounds the inner tube of the first pair) is connected to a corresponding end of the outer coaxial tube of the second pair. The one end of the outer tube in the second pair is then connected to the free end of the outer tube of the first pair. By this multiple tube-pair arrangement, the length of coaxial support tubes can be made shorter for the same wall thickness of the tubes. For even shorter tubes, additional pairs of tubes could be added, each pair adding to the total thermal conductivity path, and therefore allowing the length of the tubes for all pairs to be shortened for the same thermal gradient isolation. At each end where one tube is connected to another in a multiple pair arrangement, the end of one tube is first flared out or in, and about half of the flared end is then reformed to a cylindrical shape with an inner or outer diameter just about equal to the inner or outer diameter of the inner or outer tube. A standing-edge weld is then used to secure the union and provide a thermal connection. For tube connections to the choke plate and mounting flange, the tube is made to just fit over the choke plate and in the mounting flange. Then the unions are secured with solder around the seam to assure a thermal connection.

The novel features of the invention are set forth with particularity in the appended claims. The invention will best be understood from the following description when read in conjunction with the accompanying drawings.

DESCRIPTION OF PREFERRED EMBODIMENTS

Figure 1:
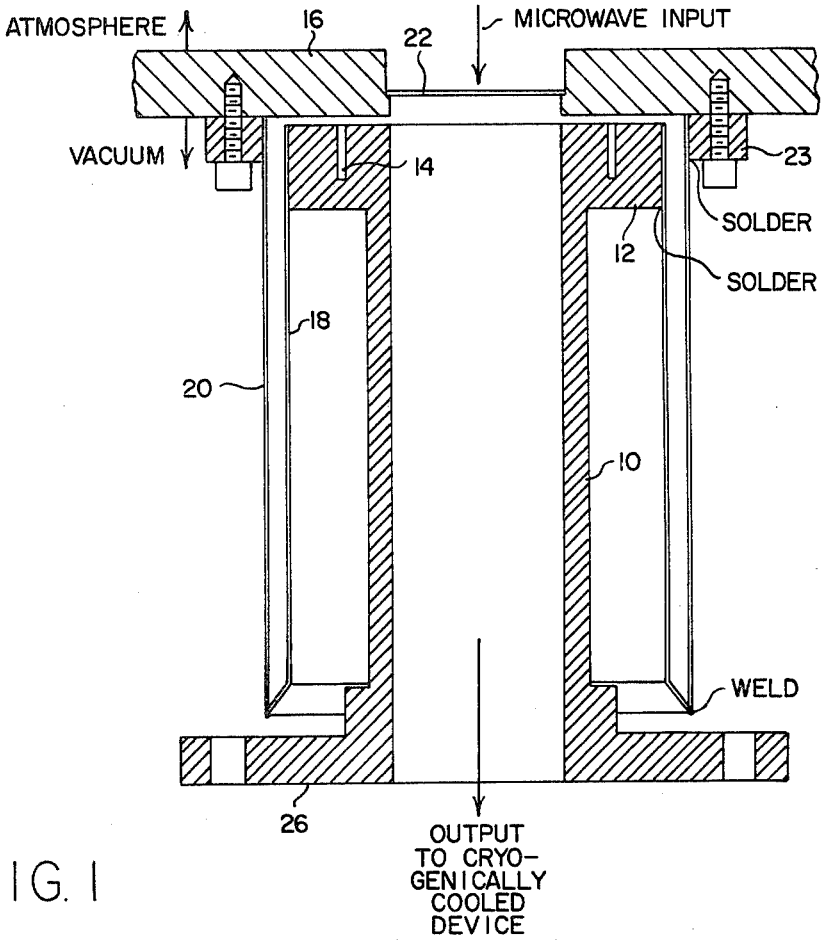
FIG. 1 is a cross section of a low-noise choked waveguide and support assembly according to a first embodiment of the invention.

Referring now to the cross section of a first embodiment shown in FIG. 1 of the drawings, a cryogenically coolable waveguide 10 is provided with an annular plate 12 having a quarter-wavelength annular choke 14. The choke plate is spaced from a mounting plate 16 as required by coaxial support tubes 18 and 20. The mounting plate is, for purposes of illustration, assumed to be at the end of a waveguide coupling a microwave antenna at 300° K. ambient temperature to a maser at a substantially lower temperature, typically 4° K. Consequently, the mounting plate 16 is provided with a window 22 of mica 0.008 cm thick to preserve the vacuum of the maser.

The inner tube 18 has an inner diameter which just fits over the choke plate, and the outer tube 20 has an outer diameter that just fits the inner diameter of a mounting flange 23. The unions thus formed between the tubes and mounting flange are secured structurally and thermally with silver solder. The inner tube 18 is connected at its free end to the free end of the outer tube 20 by a heliarc (fusion) weld. To facilitate that, one of the tubes (the inner tube in this illustration) is flared so that an edge weld may be used. The weld seals the space between the tubes which is connected by the choke plate to the waveguide 10 that is in turn connected to a vacuum pump associated with the cryogenically cooled system to which the waveguide is connected through an output flange 26.

The tubes are preferably made of stainless steel with a length and thickness selected for the temperature gradient between the mounting plate 16 and the flange 26. Assuming the flange 26 is at 70° K., while the mounting plate 16 is at 300° K., the temperature gradient of 230° K. may be sustained with stainless steel tubes of 0.025 cm wall thickness, and a length of about 4 inches. If the wall thickness is reduced by a factor of 2, thereby increasing its resistance to thermal conduction correspondingly, the length of the tubes may be reduced by a factor of 2. Thus, after a proper choice of tube material and wall thickness for known low thermal conductivity, a tube length may be selected to sustain any desired temperature gradient through this folded thermal path structure.

Figure 2:
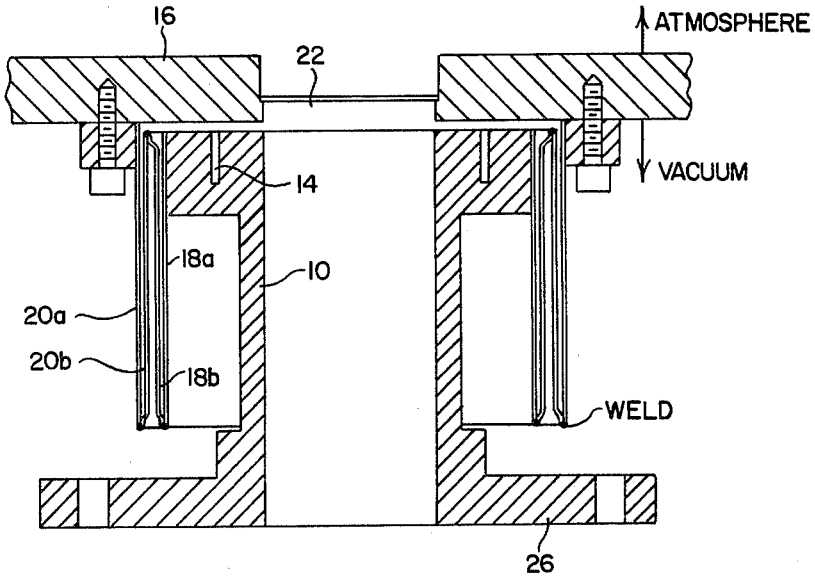
FIG. 2 is a cross section of a second embodiment of the invention.

If a shorter structure is required than can be achieved by this folded thermal path to satisfy particular space limitations, the tubes can be effectively cut in half and folded again, as shown in FIG. 2 wherein the cut tubes are designated 18*a*, 18*b*, and 20*a*, 20*b*. Other elements common to the structure of FIG. 1 are designated by the same reference numerals. The first half of the tubes 18*a* and 20*a* form one pair of coaxial tubes as before, and the second half of the tubes 18*b* and 20*b* form a second pair of coaxial tubes disposed between the tubes of the first pair. The free end of the inner tube 18*a* in the first pair is connected to one end of the inner tube 18*b* of the second pair by flaring in the tube 18*b* and reforming about half of the flare to a cylindrical shape with an inner diameter just about equal to the outer diameter of the inner tube 18*a*. The free end of the outer tube 20*a* in the first pair is similarly connected to one end of the outer tube 20*b* of the second pair by flaring out the tube 20*b* and reforming about half of the flare to a cylindrical shape with an outer diameter just about equal to the inner diameter of the outer tube 20*a*. The free ends of the tubes 18*b* and 20*b*, the second pair of tubes, are then similarly connected by flaring in, or out, one tube and reforming the flared tube to just about fit the outer, or inner, diameter of the other tube. The standing edges of these three connections are then welded.

Because the tubes in the second embodiment are shorter than in the first, even thinner stainless steel may be used, such as 0.004 inch wall thickness, thus further lowering the thermal conductance of the folded thermal path, and thereby allowing further reduction of the total thermal path for the double folded structure. If necessary to further reduce the length of the waveguide 10, without reducing the total thermal path length, or to increase the total thermal path length without increasing the length of the waveguide 10, additional pairs of tubes could be added in a strictly analogous manner.

It should be noted that the flared-and-reformed connection between tubes is used in the second embodiment only because thinner tube walls are used. If the tubes were to be made of the same wall thickness as in FIG. 1, the tubes would not need to be flared and reshaped. Instead, they could be simply flared and edge welded as in the embodiment of FIG. 1. In fact it would be permissable to weld the two tubes at their ends to make a connection without flaring one out, or in to meet the other, but it is preferable to flare one tube to the other to facilitate maintaining the tubes coaxially aligned while welding, and to edge weld by fusion of the tubes without adding welding material. However, how the connections are to be made and secured is subject to variation, or improvement. All that is required is that the connection be secure and provide thermal conduction.

In some applications, such as in using the waveguide 10 to couple microwave energy (entering through the mica window 22) to a maser, two similar low-noise isolated waveguide assemblies may be required in tandem to pass through two cryogenic cooling stages. The waveguide choke plate 16 of the second would then be connected to the output flange 26 of the first. The mounting 23 of the second would be secured to some structure that encloses the first cryogenic cooling stage that maintains the output flange 26 of the first at a low temperature, such as 70° K., while the output flange 26 of the first is connected to structure at a lower temperature, such as 4° K.

In summary, a cryogenically coolable waveguide is supported by a plurality (two or more) of coaxial stainless steel tubes connected in cascade with a choke plate connecting one end of the cascaded tubes to a mounting plate at one end of the waveguide or to the output flange of a similar structure, and with an output flange connected to the other end of the cascaded tubes at the other end of the waveguide. All connections are soldered or welded to provide good thermal connections between the stainless steel tubes, and between the choked end of the waveguide and the structure to which it is mounted. A vacuum is maintained inside of the structure to which mounted, while the outside is maintained at atmospheric pressure, as indicated in FIG. 1. The mica window maintains a vacuum seal for the structure inside (below the plate 16). While previous X-band input line and window assemblies gave a 3° to 3.5° K. noise temperature contribution, the present invention in either embodiment contributes only 0.32° K. of noise temperature, an order of magnitude less.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A support for a low-noise choked waveguide coupling into a cryogenically cooled device microwave energy passing through a mounting flange at one temperature, said support comprising coaxial low thermal conduction tubes of different diameter surrounding said waveguide, said tubes being connected in cascade, one to another at only one end of the one adjacent to another, to form one single conductive path through tubes thus connected in cascade from said mounting flange to a second flange, said second flange having a quarter wavelength choke at a lower temperature for connection to said device, and a vacuum seal at each connection of one tube to another, thereby to provide a long thermal conduction path folded into a small space, said cascade connected tubes also serving to form a vacuum enclosure for said waveguide.

2. The support for a low-noise choked waveguide as defined in claim 1 wherein said tubes are metal and each vacuum seal connection between tubes is made by welding adjacent edges together.

3. A support for a low-noise choked waveguide as defined in claim 1 wherein said tubes are made of thin stainless steel and each vacuum seal connection between tubes is made by welding adjacent edges together.

4. A support for a low-noise choked waveguide as defined in claim 3 wherein connection between adjacent tubes is made by flanging the edge of one tube out to meet the edge of another tube and the meeting edges are welded together.

5. A support for a low noise choked waveguide as defined in claim 4 wherein the flanged edge of one tube is reformed to a cylindrical shape that just fits the other tube to provide a standing edge to weld, and wherein said standing edge is welded by a fusion.

6. A support for a low noise choked waveguide as defined in claim 5 wherein connection to said mounting flange and said second flange is sealed with solder.

7. A cryogenically coolable waveguide supported by a plurality of coaxial stainless steel tubes connected in cascade with vacuum seal connections, said tubes being of different diameters and placed one within the other for a folded low thermal conduction path of a length equal to the total length of said tubes, a mounting flange connected to the outer tube with a vacuum seal and a flange on said waveguide connected to the inner tube, said waveguide flange having a quarter wavelength choke, and said inner tube being of a length to space said waveguide flange from said mounting flange to provide a choke gap.

8. Apparatus as defined in claim 7 wherein the number of said tubes is 2N, and N is an integer.

9. Apparatus as defined in claim 8 wherein said tubes are connected by flanging out one tube to meet the edge of another tube, and the meeting edges are welded together.

10. Apparatus as defined in claim 9 wherein the flanged edge of one tube is reformed to a cylindrical shape that just fits the other tube to provide a standing edge to weld, and wherein said standing edge is welded by a fusion.

11. A cryogenically coolable waveguide having a first mounting flange, said mounting flange having a quarter-wavelength choke, said mounting flange being thermally spaced from a mounting plate at a higher temperature by at least one pair of coaxial support tubes which surround said waveguide, one end of the innter tube being connected to said mounting flange of said waveguide, and the free end of the inner tube being connected to a corresponding free end of the outer coaxial tube, the other end of the outer coaxial tube being connected to a second mounting flange that is adapted to be connected to said mounting plate with the face of the mounting plate spaced from said first mounting flange to provide a choke gap.

12. Apparatus as defined in claim 11 including a second pair of coaxial tubes, the free end of the inner tube in the first pair being connected to the one end of the inner tube of the second pair, and the free end of the inner tube of the second pair being connected to a corresponding end of the outer coaxial tube of the second pair, the one end of the outer tube in the second pair then being connected to the free end of the outer tube of the first pair, thus providing a multiple tube-pair arrangement, whereby the length of coaxial support tubes can be made shorter for the same wall thickness of the tubes.

13. Apparatus as defined in claim 12, wherein at each end where one tube is connected to another in a multiple pair arrangement, the end of one tube is first flared, and then reformed to a cylindrical shape with a diameter to just fit the other tube, and wherein a standing-edge weld is used to secure the union and provide a vacuum seal.

14. Apparatus as defined in claim 13 wherein tube connections to the choke plate and mounting are by providing diameters for the tubes to just fit over the choke plate and in the mounting flange, and wherein the unions are secured with solder around the seam to assure a vacuum seal.

15. A structure for supporting a choked waveguide with a proper choke gap from a mounting plate in a cryogenically cooled space, said mounting plate having a window for sealing a vacuum in the cooled space, and said window being in alignment with said waveguide, comprising a mounting flange, an annular plate and at least one pair of stainless steel coaxial tubes, the outer tube being connected to said mounting flange secured to said mounting plate, and the inner tube being connected to said annular plate, said annular plate having a quarter wavelength choke around said waveguide, one tube at each free end of adjacent tubes being flared out to meet the adjacent tube with an edge connection, and a fusion weld around the entire connection to provide a thermal connection and seal.

* * * * *